US005154243A

United States Patent [19]

Dudman

[11] Patent Number: 5,154,243

[45] Date of Patent: Oct. 13, 1992

[54] BENT SUB

[76] Inventor: Roy L. Dudman, P.O. Box 1281, Luling, Tex. 78648

[21] Appl. No.: 736,260

[22] Filed: Jul. 26, 1991

[51] Int. Cl.[5] ..... E21B 7/08

[52] U.S. Cl. ..... 175/75; 175/61

[58] Field of Search ..... 175/61, 73-76

[56] References Cited

U.S. PATENT DOCUMENTS

| | | | |
|---|---|---|---|
| 2,142,858 | 1/1939 | McMahan . | |
| 2,167,194 | 7/1939 | Anderson . | |
| 2,266,383 | 12/1941 | Quintrell . | |
| 2,345,766 | 4/1944 | Miller . | |
| 2,375,313 | 5/1945 | Miller . | |
| 2,536,452 | 1/1951 | Leissler . | |
| 3,457,999 | 7/1969 | Massey . | |
| 4,655,299 | 4/1987 | Schoeffler . | |
| 4,811,798 | 3/1989 | Falgout et al. . | |
| 4,858,705 | 8/1989 | Thiery | 175/73 |
| 4,884,643 | 12/1989 | Wawrzynowski et al. | 175/75 X |
| 5,094,305 | 3/1992 | Wenzel | 175/75 X |

*Primary Examiner*—Thuy M. Bui
*Attorney, Agent, or Firm*—Vaden, Eickenroht, Thompson, Boulware & Feather

[57] ABSTRACT

There is disclosed a bent sub comprising an outer tubular member connectible to the lower end of a drill string and an inner tubular member which is longitudinally reciprocable within the outer tubular member between retracted and extended positions. The inner member includes an upper tubular section which is sealably slidable within the outer tubular member, so that differential pressure urges the inner member toward its extended position, and a lower tubular section which is connected to the upper tubular section by a ball and socket joint to permit it to be swung between aligned and bent positions and connectible at its lower end above the upper end of a drilling motor. The lower section is held against rotation caused to move between aligned and bent positions as it is reciprocated with respect to the outer member.

18 Claims, 2 Drawing Sheets

BENT SUB

This invention relates generally to well tools known as bent subs which are connectible within a drill string above a drilling motor for causing the motor to drill a deviated well bore. More particularly, it relates to improvements in bent subs of the type which are shiftable between positions to cause the motor to selectively drill either a deviated or a straight well bore.

In the drilling of a well of this type, the bore is first drilled straight, and then, when a desired level is reached, caused to deviate at an angle with respect to the straight hole. For this latter purpose, it has been conventional practice, when that level has been reached, to install a bent sub above a drilling motor, the sub comprising a tubular member permanently bent to a desired angle and connected as part of the string above the motor. When the bore has been changed to the desired angle, it is necessary to pull the drill string and remove the bent sub before continuing.

It has been proposed to avoid this "trip" into and out of the well bore by the use of a sub which is selectively shiftable between a bent position and a straight position. U.S. Pat. No. 3,457,999 discloses a bent sub which is so shiftable merely in response to manipulation of the drill string and control of the pressure of the drilling mud circulated through the string. Thus, the sub comprises an upper tubular member connectible to the lower end of the string and a lower member longitudinally reciprocable within the upper member and connectible to the motor. More particularly, the inner member is sealably slidable within the outer member to provide a downward force opposing the upward force due to weight on the string when it sets on bottom. The inner member is held against rotation with respect to the outer member and is slidable within guides on the outer member to cause it to assume a straight or aligned position when extended and a deviated or bent position when retracted.

If the weight of the string as it sets on bottom is not sufficient, it might not be possible to force the inner member of the sub of U.S. Pat. No. 3,457,999 into its retracted and locked, bent position without first drilling a section of angled hole. It was apparently thought necessary, in the use of the bent sub, to lock the inner member in both extended and retracted positions by means of pistons or buttons carried thereby for movement into recesses in the outer member in each such position in response to the pressure differential. Then, when the inner member is to be shifted to its other position, the pistons are intended to retract, upon lowering of such pressure, by means of springs carried on the outer side of the outer member. Such springs are, of course, susceptible to damage and malfunction, especially deep in a well bore.

Also, the upper end of the inner member must be essentially ball shaped to permit it to seal with respect to the inner diameter of the outer member as the inner member is shifted longitudinally between its alternate positions. This in return requires that a lower face on the outer member have a socket face to fit the ball shape, when the inner member is retracted, in order to transfer load between them. This requires the maintenance of very close tolerances during both machining of the parts and assembly.

The object of this invention is to provide a bent sub which is also shifted longitudinally between its bent and straight positions, but which is of such construction as to overcome these and other shortcomings of the prior art.

This and other objects are accomplished, in accordance with the illustrated embodiment of the invention, by a bent sub which comprises, as in the case of the above described bent sub, an outer tubular member connectible to the lower end of a drill string, and an inner tubular member which is longitudinally reciprocable within the outer tubular member between retracted and extended positions with respect thereto. However, as compared with the prior bent sub, the inner member includes an upper tubular section which is sealably slidable within the outer member, so that pressure differential urges the inner member toward its extended position, a lower tubular section which is connectible above the upper end of a drilling motor and held against rotation with respect to the outer member as it is reciprocated, and ball and socket joint which connects the lower tubular section to the upper tubular section for swinging between positions aligned and bent with respect to the upper section.

Means are provided for causing said lower section to be swung into one of its aligned and tilted positions, as the inner member is moved into its retracted position, and into the other of its aligned and tilted positions, as the inner member is moved into its extended position. As illustrated, this means comprises guide surfaces on the lower tubular section slidable within guide surfaces on the outer member which are tilted with respect to the vertical to force the lower section into each of its positions as it is reciprocated. More particularly, the guide surfaces are out of round so as to also hold said lower section against rotation with respect to the outer member.

The inner member is also adapted to be held in a retracted position, by locking piston means carried by the inner member for sliding outwardly into a recess in the outer member in response to pressure differential. However, as compared with the prior bent sub, the recess and locking piston means have cam surfaces which force the locking piston means inwardly upon reduction in the pressure differential and reciprocation between the members, thereby releasing the inner member for longitudinal movement to its extended position.

In the preferred embodiment, the upper tubular section has piston means which is responsive to differential pressure, as the inner member is moved to its extended position so as to hold the member in extended position as long as the pressure differential is sufficient to overcome the weight of the drill string applied to the bit. The area of the piston means is larger than the area of the inner member responsive to differential pressure when the inner member is in its retracted position, whereby there is only a relatively small force urging the inner member to extended position until such time that the inner member is moved to extended position and held by differential pressure in that position as long as the differential pressure is at a desired level. Thus, as illustrated, the relatively small pressure responsive area of the inner member is sealably slidable in a reduced diameter bore of the outer member, when the inner member is retracted, and adapted to move out of sealing engagement therewith as inner member is extended, and the piston means is sealably slidable in an enlarged diameter bore of the outer member which is vented to the outside of the sub prior to movement of the small pressure responsive area of the inner member out of seating engagements with the reduced diameter bore.

In the event additional force is required to move the inner member into and hold it in extended position, the inner member is sealably slidable in another reduced diameter bore of the outer member, when the inner member is retracted, and another piston which is sealably engageable in another enlarged diameter bore of the outer member which is vented to the outside of the sub, when the inner member is moveable out of the reduced bore. The invention contemplates that the inner member may have even more pistons similar to the second piston if required.

In the preferred and illustrated embodiment of the invention, the guide surfaces on the lower tubular section of the inner member and on the outer member are arranged to swing the inner member to aligned position when retracted and bent position when extended. Thus, as compared with the bent sub of U.S. Pat. No. 3,457,999, the inner tubular member need not overcome the pump out effect in order to be moved to its bent position, but in fact uses the pump out effect and the piston means on the inner member to move it to and hold it in bent position. As the bent sub follows a deviated hole, the upward force opposing the pump out effect depends upon the weight applied to bit.

In the drawings, wherein like reference characters are used throughout to designate like parts;

Figure 1B:
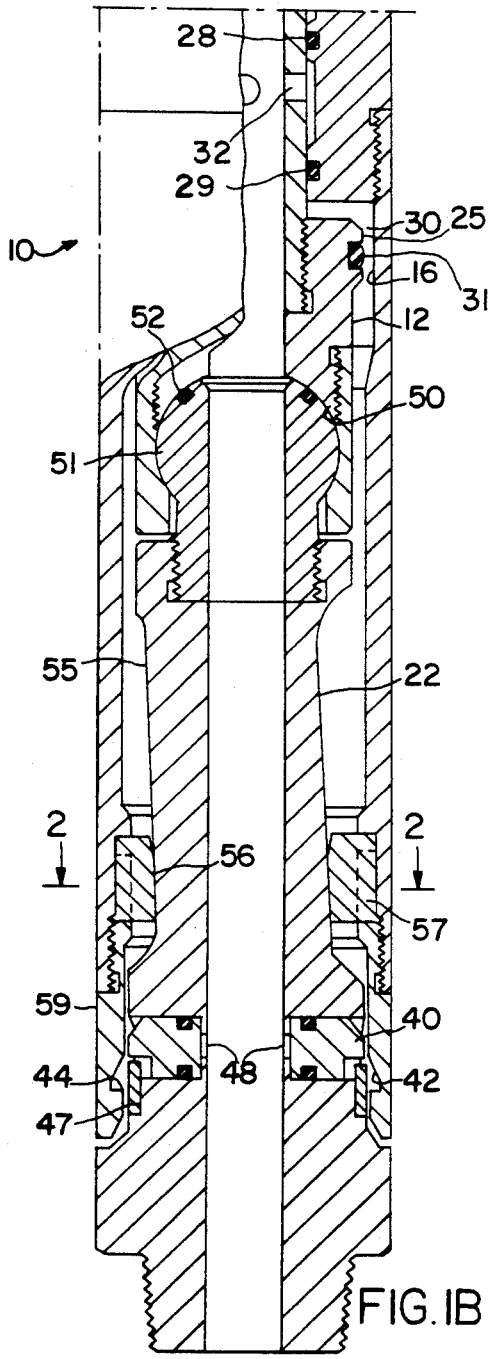
FIGS. 1A and 1B are side views, partly in section and partly in elevation, of the upper and lower ends of a bent sub constructed in accordance with the present invention, with the inner tubular member thereof shown in its retracted and aligned position with respect to the outer tubular member.
Figure 4B:
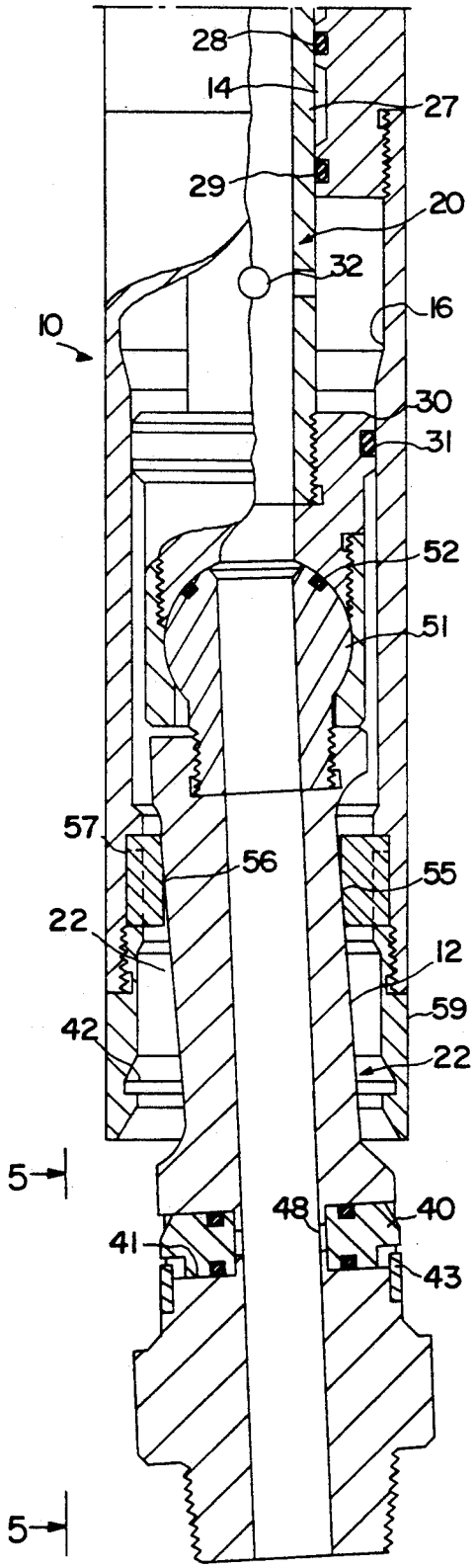
FIGS. 4A and 4B are similar to FIGS. 1A and 1B respectively, but upon lowering of the inner tubular member into its extended and tilted position with respect to the outer member.
Figure 5:
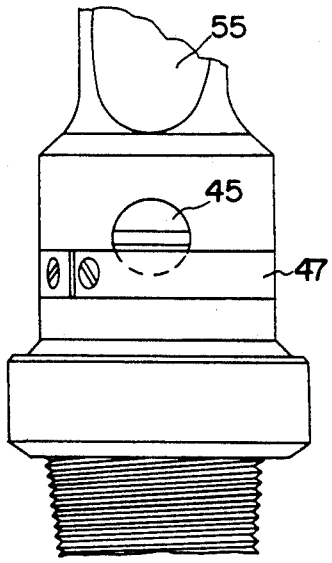
FIG. 5 is a side view of the lower most end of the inner tubular member of the bent sub, as seen along broken lines 5—5 of FIG. 4B.

With reference now to the details of the above described drawings, the bent sub, which is indicated in its entirety by reference character 10, shown to comprise an outer tubular member 11 having a threaded connection at its upper end for connection with the lower end of a drill string and a lower open end, and an inner tubular member 12 which is longitudinally reciprocable within and through the open lower end of the outer tubular member between the retracted position of FIG. 1B and the extended position of FIG. 4B, and which has a threaded connection at its lower end for connecting above the upper end of a drilling motor. In a manner to be described in more detail, the inner member is held against rotation with respect to the outer member and is caused to move from a position aligned with the outer member, when the inner member is retracted, and tilted with respect to the outer member, when the inner member is extended.

The outer tubular member is made up of threadedly connected tubular parts which form a bore therethrough having an upper reduced diameter portion 13 near its upper end, a lower reduced diameter bore portion 14 intermediate its ends, and upper enlarged diameter bore portion 15 intermediate the reduced diameter portions 13 and 14, and a lower enlarged diameter portion 16 beneath the portion 14. A port 17 is formed in the outer tubular member near the lower end of enlarged diameter bore portion 15 to connect with the outside of the tool.

The inner tubular member 12 is also made up of the threadily connected tubular parts including an upper tubular section 20 sealably sliding within the bore of the outer tubular member, whereby the upper section is urged downwardly by differential pressure, and a lower tubular section 22 which is connected at its upper end to the lower end of the upper section by means of a ball and socket joint (to be described), to permit it to swing between aligned and tilted positions. As will also be described to follow, the upper end of the lower section below the ball and socket joint is guidably slidable within the outer tubular member in order to prevent the lower section from rotating with respect to the outer tubular member and to cause the lower section to be swung between its aligned and tilted positions, as it reciprocates within the outer member.

Figure 1A:
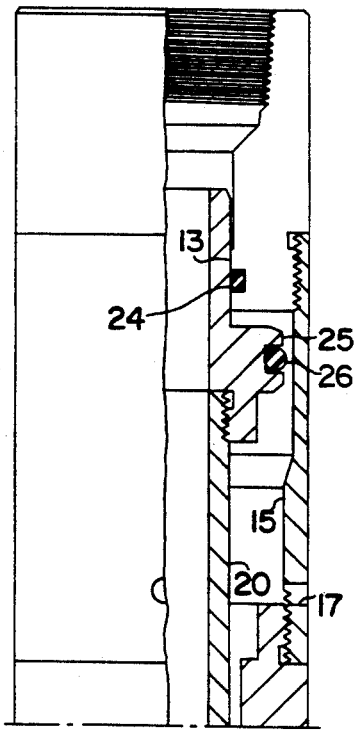
Figure 4A:
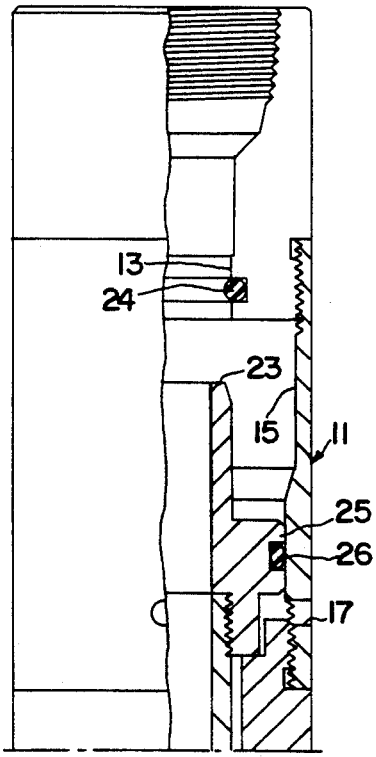

The upper end of the upper section 20 has a neck 23 of relatively small outer diameter for sliding within a seal ring 24 carried about the reduced diameter bore portion 13 of the outer tubular member when the inner tubular member is in its retracted position, as shown in FIG. 1. As the neck 23 moves downwardly past the seal ring 24, it opens the bore to piston 25 on the inner member below the neck 23 and carrying a seal ring 26 thereabout for sealably sliding within the enlarged diameter bore portion 15 when the inner member is in its extended position (FIG. 4A). However, piston 25 is out of sealing engagement therewith when the seal ring 26 is in a recessed portion in the upper end of bore portion 15 (FIG. 1A), and the recess is of such length and so arranged that the seal ring 26 moves out of sealing engagement with the bore portion 15 before the neck 23 moves upwardly within the seal ring 23 of the reduced diameter bore portion 13.

Thus, with the inner tubular member in its raised position, as shown in FIG. 1A, differential pressure within the bore of the tubular members creates only a relatively small force urging the inner tubular member downwardly to extended position. However, with little or no pressure differential and the inner member unlocked, it may be raised to cause seal ring 26 to move into the bore portion 15 beneath the recess, following which the neck 23 moves downwardly out of sealing engagement with the seal ring 24, such that increased fluid pressure within the bore of the tubular members will move the inner member into and hold it in extended position.

The upper tubular section has another reduced outer diameter portion 27 beneath the piston 25 and which is sealably slidable within seal rings 28 and 29 carried within the inner reduced diameter bore portion 14 of the outer tubular member. The area between the seal rings 26 and 28 is, of course, vented to the outside of the tubular members by means of the port 17. Also, the portion 27 has ports 32 which, in the retracted position of the upper section, are intermediate the seal rings 28 and 29, and, in the extended position, below seal ring 29 to vent the bore to the enlarged bore portion 16.

The upper tubular section also includes another piston 30 which carries a seal ring 31 thereabout for sealably sliding within the enlarged diameter bore portion 16 of the outer tubular member. When the inner tubular member is extended, as shown in FIG. 4B, and the ports 32 are below seal ring 29, the piston 30 on the inner tubular member multiplies the force to move and hold the inner tubular member downwardly to its extended position. However, the enlarged diameter bore portion 16 of the outer tubular member has a recess in its upper end which is so arranged that the seal ring 31 moves out of sealing engagement with bore portions 16, as the inner member is retracted, and before ports 32 move above the seal ring 29 to vent the space within bore portion 16 to the outside.

Figure 3:
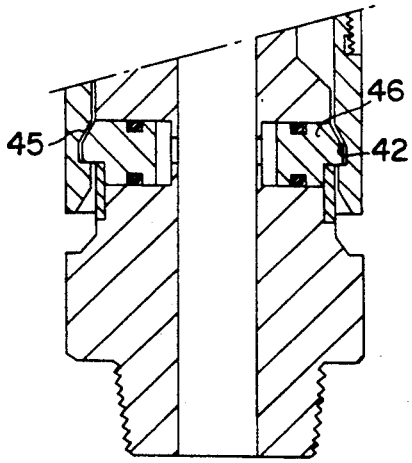
FIG. 3 is a sectional view of the lowermost end of the bent sub, and showing the inner tubular member lowered to a position in which locking pistons carried thereby are urged outwardly into a locking recess in the outer tubular member.

The inner tubular member is adapted to be held in its retracted position by means of locking pistons 40 having seal ring thereabout for sealably sliding within holes 41 formed in the lower end of the lower tubular section 22. An annular recess 42 is formed about the lower end of the inner diameter of the outer tubular member in a position to receive the locking pistons 40 when the inner tubular member is disposed in a retracted position somewhat below its fully retracted position as shown in FIG. 3. Thus, in order to hold the inner tubular member in its retracted position, pressure differential is raised to a level for urging the piston outwardly into the recesses as the inner tubular member is lowered from its FIG. 1B to its FIG. 3 position.

As shown, the locking pistons have downwardly facing shoulders 43 which rest upon upwardly facing shoulder 44 of the recess 42, when extended, both shoulders being perpendicular with respect to the axis of the tool so that the inner tubular member will be held in retracted position despite a downward force acting thereon due to differential pressure acting over the neck 23. When it is desired to release the inner tubular member for lowering to its extended position with respect to the outer tubular member, the differential pressure within the bore is discontinued, and the inner tubular member is raised to its fully retracted position of FIG. 1B to cause cam surfaces 45 on the upper ends of the locking pistons to slide over a cam surface 46 at the upper end of the recess 42. Without differential pressure in the bore, the friction of engagement of the seal rings about the locking pistons will hold them retracted, as shown in FIG. 4B, as the inner tubular member is permitted to move downwardly toward its extended position and, thus, lower the locking pistons beneath the recess 42.

The locking pistons are held within the holes 41 by means of a band 47 carried about the lower section of the inner tubular member for disposal about the holes beneath the shoulders 43 on the pistons. Walls across the inner ends of the holes to limit inward movement of the locking pistons are provided with ports 48 which permit pressure in the bore to act over the pistons.

The ball and socket connection between the upper and lower tubular sections includes a socket having a cylindrical surface 50 on the lower end of the upper section and a ball on the upper end of the lower section having a spherical surface 51 adapted to closely fit the spherical surface 50 of the socket. A seal ring 52 is carried by the ball 51 for sealably engaging the socket surface 50 in both the aligned and tilted positions of the lower section, thus sealing off the bore through the tubular members. As shown, the surface extends about more than 180° of the surface 51 so as to not only permit swinging of the lower section between its aligned and tilted positions, but also to connect its upper end to the lower end of the upper section for longitudinal movement therewith.

The inner tubular member is held against rotation with respect to the outer tubular member and caused to be swung between its aligned and tilted positions, as the inner tubular member is reciprocated between extended and retracted positions, by means of flat guide surfaces 55 formed on four sides of an intermediate portion of the lower section slidable within flat guide surfaces 56 formed on the inner sides of inserts or cams 57 mounted within the outer tubular member. More particularly, a pair of the opposite sides of the surfaces 55 and the upper and lower ends of the corresponding sides 56 extend at an angle with respect to the axis of the lower section. The other ends of surfaces 56, on the other hand, are straight and parallel to the axis to accommodate bending of the lower section as it is guided through the cam.

Figure 2:
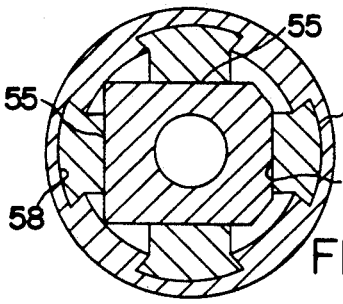
FIG. 2 is a cross sectional view of the bent sub, as seen along broken lines 2—2 of FIG. 1B.

As best shown in FIG. 2, the outer sides of the cams fit within dovetail slots 58 in the outer member and are held therein by a sub 59 on the lower end of the outer tubular member in which recess 42 is formed. As will be apparent from FIG. 4B, the sub may be removed to permit the cams to be replaced by others having guide surfaces extending at different angles with respect to the vertical.

As the above described bent sub is lowered on the drill string into a well bore, it would normally assume its extended, and thus bent, position due to the weight of the motor on the lower end. Then, when the operator reaches a point at which the well bore is to be deviated, he would lift the string until it was extended enough to disposed pistons 25 and 30 in the seal bores in the outer member, and then turn on the mud pumps so as to apply differential pressure to the pistons to fully extend the sub. As above described, this not only extends the sub, but also holds it in extended position due to the large downward force resulting from the large area of the pistons, assuming, of course, that the force is greater than the weight on bit.

After having drilled the desired angle of the well bore, the operator would then be ready to drill straight ahead. For this purpose, he would cut off the mud pumps to allow the bent sub to move to its retracted and aligned position as the pressure of the mud was vented from the pistons 25 and 30. The operator would then restart the mud pumps while the string is sitting on bottom so as to cause the locking pistons 40 to move outwardly, and then lift the string to cause the locking pistons to move into locked position, as shown in FIG. 3. As long as the mud pump is on, the operator may drill straight ahead and pick up off the bottom since the inner member is locked in its retracted position. This permits the operator to ream the well bore, and then lower the drill string to the bottom so as to continue drilling straight ahead.

In the event the hole is drifting from the desired direction, the operator may want to again change angle of the hole. For this purpose, he would turn off the mud pumps and lower the string to the bottom which, due to the cam surfaces on the locking pistons and the inside of the outer tubular member, would force the locking pistons inwardly to their unlocking positions, as shown in FIG. 1B. The operator would then lift the string to permit the sub to return to its bent position, and then turn the mud pumps back on so as to hold the sub in its bent position. Obviously, if the operator then wishes to again change to the straight aligned position, he may repeat the procedure above mentioned to cause the bent sub to return to its retracted aligned position.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A bent sub, comprising an outer tubular member connectible to the lower end of a drill string, an inner tubular member which is longitudinally reciprocable within the outer tubular member between retracted and extended positions with respect thereto, said inner member including an upper tubular section which is sealably slidable within the outer member to urge the inner member toward one of its extended and retracted positions, a lower tubular section which is connectible above the upper end of a drilling motor and held against rotation with respect to the outer member as it is reciprocated, a ball and socket joint connecting the lower tubular section to the upper tubular section for swinging between positions aligned and bent with respect to the upper section, and means causing said lower section to be swung into one of its aligned and tilted positions, as the inner member is moved into its retracted position, and into the other of its aligned and tilted positions, as the inner member is moved into its extended position.

2. As in claim 1, wherein said lower section has guide surfaces slidable within tilted guide surfaces on the outer member to force the lower section into each of its positions as it is reciprocated.

3. As in claim 2, wherein said guide surfaces are out of round so as to hold said lower section against rotation with respect to the outer member.

4. As in claim 1, including means for releasably holding said inner member in a retracted position.

5. As in claim 4, wherein the holding means comprises a recess in the bore of the outer member and locking piston means carried by the inner member for sliding outwardly into the recess in response to differential pressure across said locking piston means.

6. As in claim 5, wherein said recess and locking piston means having cam surfaces which force the locking piston means inwardly upon movement of the inner member toward the other position.

7. As in claim 4, wherein the upper tubular section has piston means which is responsive to differential pressure. as the inner member is moved to its extended position, so as to hold said inner member in extended position when the differential pressure is at a desired level to overcome the weight of the drill string applied to the bit.

8. As in claim 7, wherein the inner member has a relatively small pressure responsive area which is sealably slidable in a reduced diameter bore of the outer member, when the inner member is retracted, and movable out of sealing engagement therewith as inner member is extended, and the piston means includes a piston which is sealably slidable in an enlarged diameter bore of the outer member which is vented to the outside of the sub, prior to movement of said small pressure responsive area out of sealing engagement with the reduced diameter bore.

9. As in claim 8, wherein the inner member is sealably slidable in another reduced diameter bore of the outer member, when the inner member is retracted, and movable out of sealing engagement therewith, when the inner member is extended, and the piston means includes a second piston which is sealably slidable in another enlarged diameter bore of the outer member which is also vented to the outside of the sub, prior to movement of said small pressure responsive area out of sealing engagement with the reduced diameter bore.

10. A bent sub, comprising an outer tubular member connectible to the lower end of a drill string, an inner tubular member which is longitudinally reciprocable within the outer tubular member between retracted and extended positions with respect thereto, said inner member including an upper tubular section which is sealably slidable within the outer member, to urge the inner member toward its extended positions.

a lower tubular section which is connectible above the upper end of a drilling motor and held against rotation with respect to the outer member as it is reciprocated, and a ball and socket joint connecting the lower tubular section to the upper tubular section for swinging between positions aligned and bent with respect to the upper section, and means causing said lower section to be swung into its aligned position, as the inner member is moved into its retracted position, and into its tilted position, as the inner member is moved into its extended position.

11. As in claim 10, wherein said lower section has guide surfaces slidable within tilted guide surfaces on the outer member to force the lower section into each of its positions as it is reciprocated.

12. As in claim 11, wherein said guide surfaces are out of round so as to hold said lower section against rotation with respect to the outer member.

13. As in claim 10, including means for releasably holding said inner member in a retracted position.

14. As in claim 13, wherein the holding means comprises a recess in the bore of the outer member and locking piston means carried by the inner member for sliding outwardly into the recess in response to the differential pressure across said locking piston means.

15. As in claim 14, wherein said recess and locking piston means having cam surfaces which force the locking piston means inwardly upon movement of the inner member toward its retracted position.

16. As in claim 10, wherein the upper tubular section has piston means which is responsive to differential pressure, as the inner member is moved to its extended position, so as to hold said inner member in extended position when the differential pressure is at a desired level to overcome the weight of the drill string applied to the bit.

17. As in claim 16, wherein the inner member has a relatively small pressure responsive area which is sealably slidable in a reduced diameter bore of the outer member, when the inner member is retracted, and movable out of sealing engagement therewith as inner member is extended, and the piston means includes a piston which is sealably slidable in an enlarged diameter bore of the outer member which is vented to the outside of the sub, prior to movement of said small pressure responsive area out of sealing engagement with the reduced diameter bore.

18. As in claim 17, wherein the inner member is sealably slidable in another reduced diameter bore of the outer member, when the inner member is retracted, and movable out of sealing engagement therewith, when the inner member is extended, and the piston means includes a second piston which is sealably slidable in another enlarged diameter bore of the outer member which is also vented to the outside of the sub, prior to movement of said small pressure responsive area out of sealing engagement with the reduced diameter bore.

* * * * *